United States Patent [19]

Windelbandt et al.

[11] 4,123,899

[45] Nov. 7, 1978

[54] METHOD FOR BENDING CHAIN LINKS AND CHAIN LINK BENDING MACHINE

[75] Inventors: Herbert Windelbandt, Aachen-Laurensberg; Günter Ditges, Rodenkirchen-Weiss, both of Germany

[73] Assignee: Meyer, Roth & Pastor Maschinenfabrik GmbH, Cologne, Germany

[21] Appl. No.: 704,685

[22] Filed: Jul. 12, 1976

[30] Foreign Application Priority Data

Jul. 12, 1975 [DE] Fed. Rep. of Germany ..... 2531290

[51] Int. Cl.[2] ..... B21L 1/02

[52] U.S. Cl. ..... 59/27; 59/35 R

[58] Field of Search ..... 59/27, 18, 12, 22, 23, 59/24, 25, 35

[56] References Cited

U.S. PATENT DOCUMENTS

| | | | |
|---|---|---|---|
| 1,032,365 | 9/1912 | Baker | 59/27 |
| 2,299,486 | 10/1942 | Miller | 59/27 |
| 2,427,535 | 9/1947 | Robertson | 59/27 |

FOREIGN PATENT DOCUMENTS

| | | | |
|---|---|---|---|
| 2,028,266 | 12/1971 | Fed. Rep. of Germany | 59/27 |

*Primary Examiner*—C.W. Lanham
*Assistant Examiner*—Gene P. Crosby
*Attorney, Agent, or Firm*—Spencer & Kaye

[57] ABSTRACT

Chain links are formed of wire pins by bending each wire pin about work faces of a mandrel with bending tools which engage the pin at the two end zones thereof. The locations of engagement describe, at least during the terminal phase of the bending operation, a circular involute, the reference point of which coincides with the center of curvature of the respective work face of the mandrel.

9 Claims, 7 Drawing Figures

METHOD FOR BENDING CHAIN LINKS AND CHAIN LINK BENDING MACHINE

BACKGROUND OF THE INVENTION

The invention relates to a method for bending chain links of wire pins of a given length wherein the two free ends of the wire pin are bent around a mandrel.

All prior art bending processes operate in that two bending tools performing translatory movements carry along the free pin ends and initially bend them into the shape of a C and thereafter a second translatory movement transverse to the first movement, either by the same bending tools or by special lateral bending stools, completely closes the C-shaped prebent chain link (e.g. German Offenlegungsschrift No. 21 23 561). However, this process is possible only if the bending tools roll over the surface of the wire pin to be bent or slide on the surface, i.e. if relative movement takes place between the contact surface of the bending tool and the wire pin itself. However, this process has the drawback, which previously has had to be accepted, that the surface of the wire pin to be bent is deformed to a significant degree. Since, due to the shortened length of the leg of the remaining portion to be bent, the final bending requires considerable forces, the surface of the wire pin undergoes deformations and damage at precisely that location in the area of the free pin ends which, during the subsequent welding process, the welding electrodes will contact. Since the quality of the contact surfaces for the welding electrodes appreciably influences also the quality of the (weld and it is particularly important in the manufacture of chains that link after link the same quality of weld be obtained), such partially varying surface deformations have a direct influence on the quality of the weld.

SUMMARY OF THE INVENTION

It is the object of the invention to provide a bending process which will avoid the above-described drawbacks. This is accomplished, according to the invention, by applying a bending tool in the area of each of the free pin ends which bending tool is guided during the bending process on a curved path such that the point of contact of the bending tool at the pin performs, at least in the final phase of the bending process, an approximate circular involute, whose point of reference corresponds to the center of curvature of the side of the bending mandrel facing the particular bending tool. This manner of proceeding has the advantage that the part of the bending tool which contacts the pin is practically not displaced during the bending process so that no sliding or rolling marks are produced on the surface of the pin. Whereas in the known processes the bending rollers rolling over the pin produce particularly high areal pressures, due to the linear contact between roller and pin, particularly in the end region of the bending process as a result of the high bending forces exerted on the pin during this process, the process according to the invention, since there is practically no relative movement between the bending tool and the pin, provides relatively large contact surfaces so that the areal pressure is substantially reduced. A further advantage of the process according to the invention is that the forces attack at the same point during the entire bending process, i.e. preferably at the longest bending lever, so that a defined force function can be prepared for the entire bending process, which permits corresponding control of an apparatus for practicing the method. Moreover, a further advantage is seen in that at least in the final phase of the bending process the strong bending force acts as a normal force on the pin end. Since this process also permits the bending process to be continuous, the resulting flow zones propagate in the pin at a uniform speed so that the previously noted locally occurring velocity peaks with their inherent danger of locally limited structural disintegration and later crack formation are avoided.

According to a further feature of the process of the invention the path of movement of the contact point of the bending tool (which path corresponds at least approximately to a circular involute) is produced by pivoting a rotatably mounted lever, the bending tool performing a relative movement with respect to the lever. This mode of operation considerably simplifies the drive problems since a pivoting process can be controlled relatively easily with respect to its sequence of movements and can be adapted in a simple manner in its structural design to the various dimensions of the chain links to be bent.

According to another feature of the process of the invention the path of movement of the contact point of the bending tool (which path corresponds at least approximately to a circular involute) is produced by the superposition of a movement taking place transversely to the axis of the unbent pin (Y direction) and a movement taking place approximately parallel to this axis (X direction), the movement in the X direction being controlled as a function of the movement in the Y direction. Since the path of movement of the contact surface of the bending tool is a mathematically definable curve which permits guidance of the sequence of movement in the X direction as a function of the Y direction, controlling such a superposed movement can be effected without much difficulty.

According to a further feature of the process of the invention the bending tool performs a relative movement in the form of a pivotal movement with respect to the pivot lever. This movement is positively controlled forced motion) as a function of the movement of the bending tool in the X direction. This assures precise guidance of the bending tool so that the contact surface of the bending tool moves according to the given curve of movement.

The invention further relates to a chain link bending machine for practicing the above-discussed method. The machine includes a preferably interchangeable bending mandrel, a holder for pressing the wire pin to be bent against the bending mandrel as well as bending tools. The chain link bending machine according to the invention is characterized in that two bending tools are provided, that each bending tool is provided with a jaw which can be applied in the region of the free end of the wire pin to be bent and which is movably mounted at a pivot lever which is in communication with a pivot drive for producing the bending force. With the aid of a chain link bending machine of such design, the bending method according to the invention can be performed in one stage with but two oppositely acting pivot levers. The use of pivot levers for producing the required curved path additionally results in a simple and compact structure.

According to a further feature of the chain link bending machine of the invention the fulcrum of the pivot lever is mounted to be adjustable in two coordinate directions within a given range in a plane which is parallel to the bending plane. This arrangement has the advantage that the machine can be adjusted without major difficulties to various chain link sizes both with respect to the diameter of the wire pin, in which case the bending tool has to be exchanged as well, and with respect to the outer dimensions of the chain link itself. As usual, in addition to adjusting the pivot levers, the mandrel and the turning grippers must also be exchanged. p According to a further feature of the chain link bending machine of the invention in case of a bending tool which is pivotally mounted at the pivot lever, the distance of the pivot of the bending tool is adjustable with respect to the fulcrum of the pivot lever. With this measure it is possible to adjust the machine in a simple manner to different radii of curvature of the chain links to be bent.

According to another feature of the invention, two parallel arranged pivot levers are provided which are connected together by a coupling rod, one end of which is extended beyond the point of articulation at the pivot lever and is connected with the bending tool. This embodiment has the advantage that the bearing for the pivot lever can be removed from the region of the bending mandrel and displaced to an area of better accessibility so that the structure as a whole is simplified.

According to another feature of the above arrangement the points of articulation of the coupling rod are fastened to the pivot lever to be adjustable with respect to the fulcrums of the pivot levers. This makes it possible to adapt the chain link bending machine in a simple manner to the size of the chaink link to be bent.

According to a further feature of the chain link bending machine of the invention the fulcrum of the pivot lever is mounted on a carriage which can be moved back and forth. The carriage as well as the pivot lever each are connected with a drive device to generate the bending force. Further, a control device is provided which controls the sequence of movement of the carriage and the pivot lever as a function of a given path of movement of the bending tool. Since the process according to the invention is based on a mathematically accurately definable path of movement for the bending tool, this embodiment of the invention permits practically accurate guiding of the bending tool on the mathematically predetermined path of movement since the superposed movements of carriage and pivot lever permit simultaneous movement in two coordinate directions of the bending plane.

According to a further feature of the chain link bending machine of the invention, each bending tool is connected with a drive to generate the pivotal movement with respect to the pivot lever. By the provision of positive guidance of the pivot movement of the bending tool with respect to the pivot lever it is accomplished that in cases where the circular involute is performed only approximately over part of the path of movement of the bending tool, tilting forces which may possibly act on the bending tool are counteracted.

DESCRIPTION OF THE PREFERRED EMBODIMENTS

Figure 1:
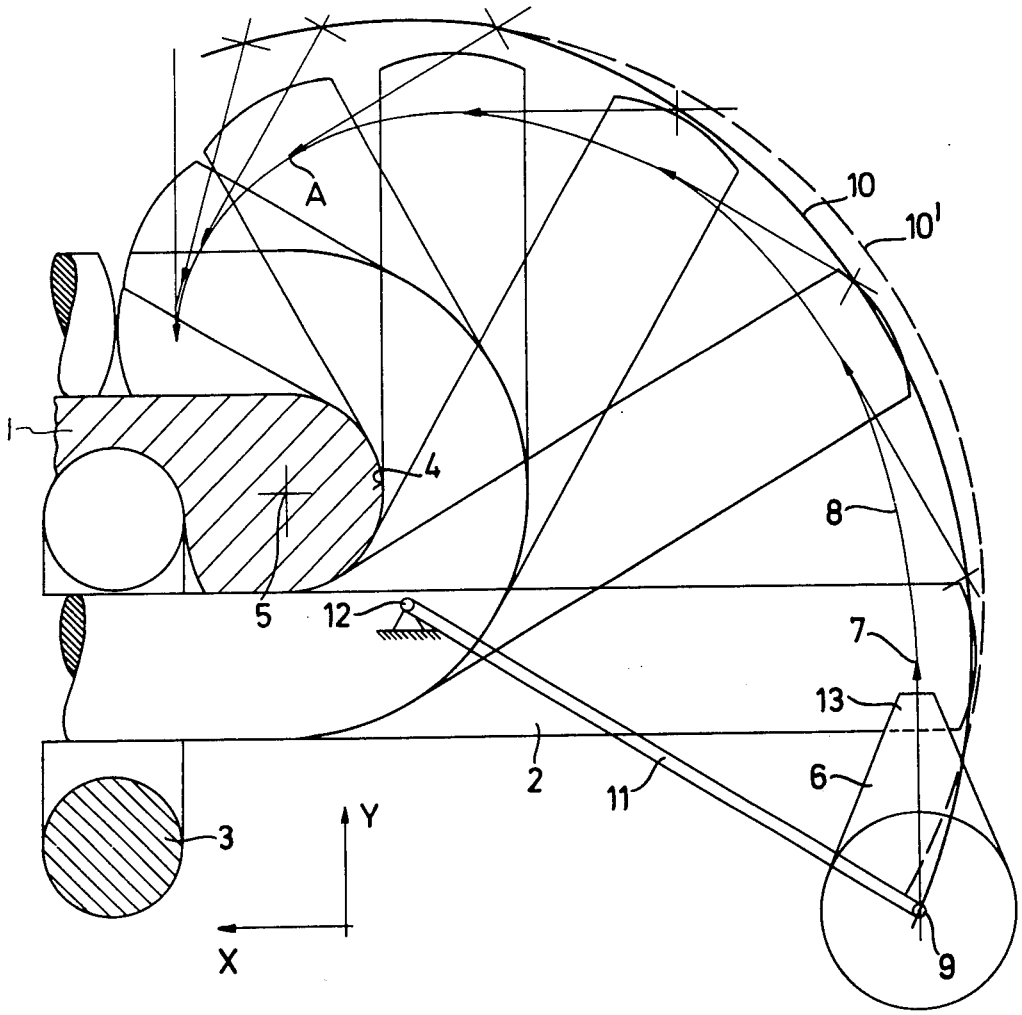
FIG. 1 is a schematic representation of the sequence of movements of the bending process.

The principle of the bending process will be explained in detail in connection with FIG. 1. Here, as in the prior art bending processes, a bending mandrel 1 is provided. A wire pin 2 of given length is inserted and pressed against the underside of the bending mandrel by a holder (not shown). A chain link 3 which has been completely bent during the preceding bending process has here been inserted into a recess in the bending mandrel 1 with the aid of a turning and gripping device of known structure which is not shown here in detail so that the wire pin 2 to be bent can be pushed through the already completely bent chain link 3. In this way, a chain is joined together link after link and the links are then individually welded in a known manner in a chain link welding machine.

In accordance with the desired chain shape, the bending mandrel 1 is provided at both sides with a semicircular bending profile (work face) 4 and the associated center point 5. A bending tool 6 which is freely rotatably mounted on an actuated member (such as a pivot lever 11) and which is applied with its jaw-like terminus 13 in the end region of wire pin 2 is now guided so that the point 7 where the force is applied moves along a path of movement 8 which corresponds to a circular involute with reference to the curvature of the bending mandrel and its center point 5. Thus, stated differently, as the pin 2 is bent around the mandrel 1 by the tool 6, the location of engagement between the tool 6 and the pin 2 will not shift relative to the pin 2, but the tool 6 will be guided in the above-discussed circular involute. This is so because the friction generated by the bending force and the bending resistance of the pin 2 maintains the tool 6 in a fixed contact point relationship with the pin 2 and further, by virtue of the free pivotal motion of the tool 6 relative to the actuated member (such as the pivot lever 11) the tool 6 is capable of maintaining such a fixed contact point as the the pin 2 is being wrapped around the mandrel 1. The illustration of FIG. 1 here shows the various positions of the free end of the wire pin corresponding to the progress of the bending process. The bending force for each individual position is shown with respect to the pin axis as the point of attack of the force. The illustration shows that during the entire bending process the force applied has a direction perpendicular to the pin axis. Since for structural reasons each bending tool must be guided at a certain distance from the pin axis, a path of movement 10 results for an assumed point 9 on the bending tool which also constitutes a circular involute but which is shifted in phase with respect to the path of movement of the point of application of force. The illustration here immediately shows that in view of these circumstances the bending tool 6 must perform a relative movement with respect to the guide for generating the path of movement 10 of the bending tool since, in correspondence with the progress of the bending process, the angle enclosed by the effective direction of the bending force continuously changes with respect to the path of movement 10. In the present case, the relative movement consists of a pivotal movement with respect to the guiding of bending tool 6. The guiding may here be effected by two carriages which are moved perpendicularly to each other as a function of the law of motion given by the path of movement 10, one carriage carrying the bending tool 6. Other embodiments will be explained in detail in connection with FIGS. 5 and 6. Since the path of movement constitutes a mathematically definable curve, the given sequence of motion can be realized without difficulty with the aid of an appropriate control. For the sake of clarity it is pointed out at this time that the described bending process is a symmetrical process. Thus, as can be seen in the sketch of, for example, FIG. 4, the two free ends of the inserted wire pin 2 are bent simultaneously and with the same speed so that the machine is likewise stressed symmetrically.

Figure 7:
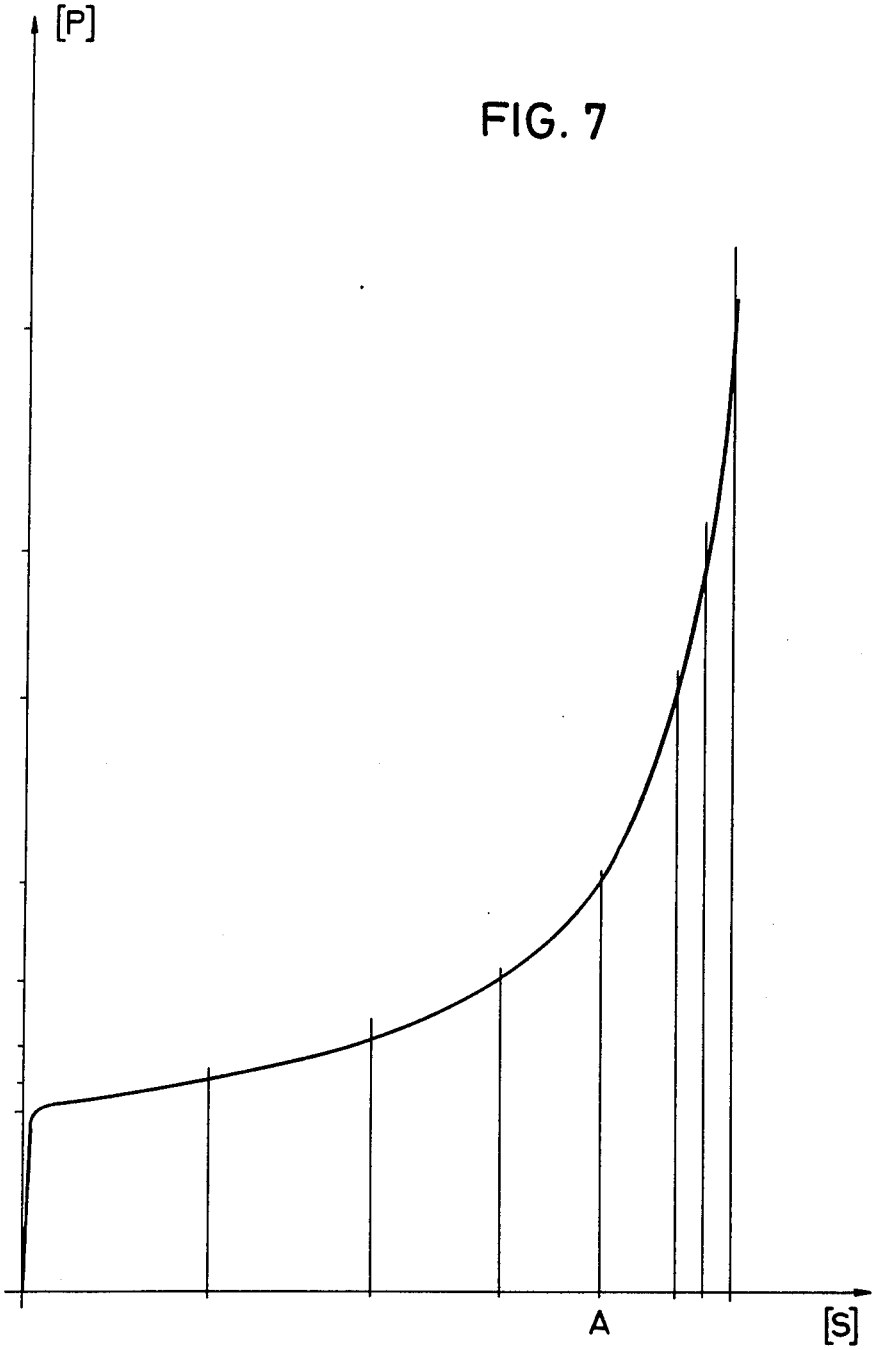
FIG. 7 is a diagram illustrating the bending force P as a function of the bending path S.

FIG. 1 shows a further mode of operation principle in which, instead of the generation of the movement curve by simultaneous movement of the bending tool in the direction of an X coordinate and a Y coordinate, the bending process is effected with the aid of an only approximated circular involute. This can be done, for example, by a pivot lever 11 which is stationarily mounted on the machine frame so that the resulting path of movement for point 9 is the dashed curve 10'. The position of the stationarily arranged fulcrum 12 of pivot lever 11 with respect to the center of curvature 5 of the bending mandrel is here determined by the end position of the bending tool 6 after completion of the bending process so that in the final phase of the bending process the path of movement 10' which constitutes a circular arc coincides with the path of movement 10 which constitutes a circular involute. The deviations of the actual path of movement 10' from the exact path of movement 10 occurring in this mode of operation at the beginning of the bending process are without influence in view of the usual dimensional tolerances of the wire pins to be bent and need be considered only in the design of the contact surface of the jaw-shaped terminus 13 of the bending tool 6. This can be easily seen in the force path diagram of FIG. 7. The point A identified in the diagram of FIG. 7 corresponds to position A of the free end of the wire pin of FIG. 1 to be bent. Up to this position, the bending force to be exerted is only about $\frac{1}{3}$ of the bending force required to bend the pin into the final position. However, in this position the circular path of movement 10' coincides, with sufficient accuracy for practical operation, with the exact path of movement 10 which corresponds to a circular involute so that, particularly in the critical region, no adverse influences result from the deviations of the actual path curve from the exact path curve.

Figure 2:
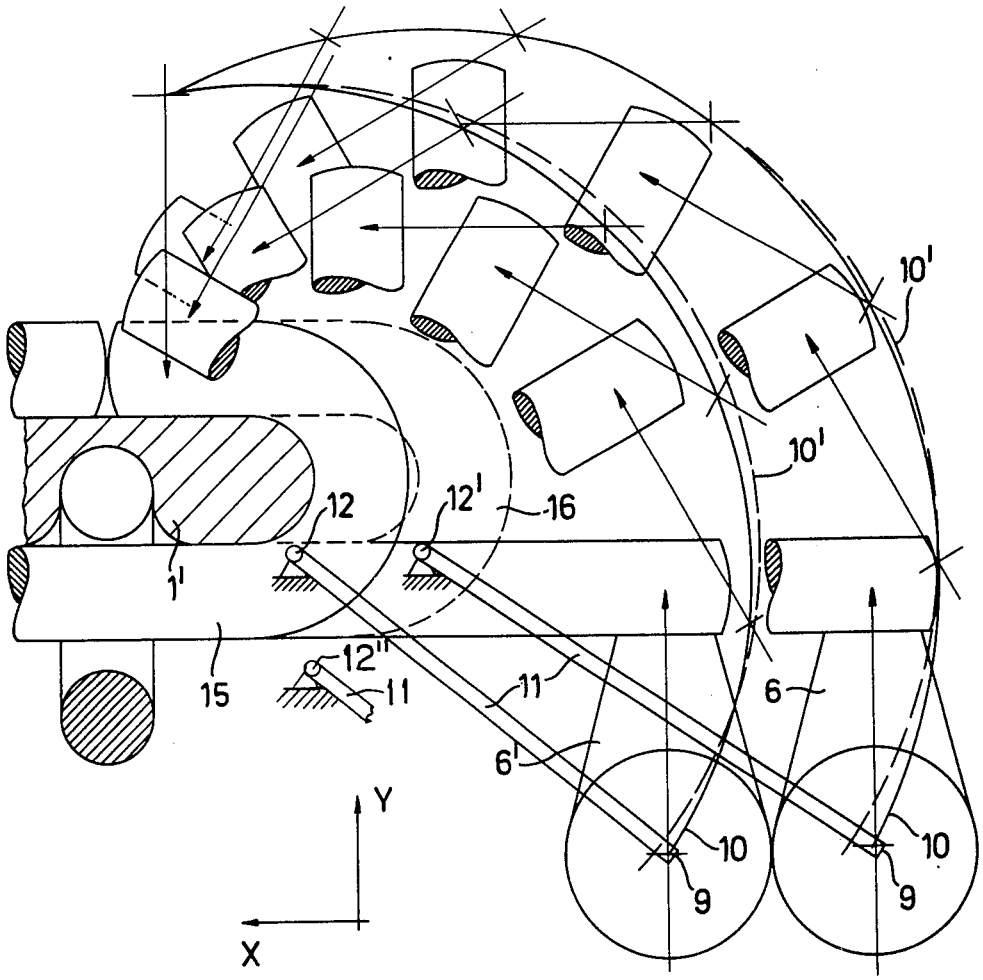
FIG. 2 is a schematic representation of the sequence of movements for chain links with different length dimensions and with identical pin diameter.

FIG. 2 shows two courses of movement during the bending of two chain links of the same diameter but of different lengths. The shorter chain link 15 is bent about an appropriately shaped bending mandrel 1' while the chain link 16 which is shown in dot-dash lines in the area of its curvature is bent about a bending mandrel of correspondingly wider design, the radius of curvature being identical in both cases. If the bending tool 6' is guided by a simultaneous superposed movement both in the X and Y coordinate directions (corresponding to the drawn coordinate cross) there again results the solid-line path curve 10 which corresponds to an exact circular involute which has been shifted in phase with respect to the path curve of the point of force application. If the movement is provided by means of a pivot lever 11, the dashed path curve 10' results for the point 9 which will be correspondingly shifted. Otherwise the sequence of movement of the bending process corresponds to the bending process described in connection with FIG. 1.

If now the longer chain link 16 is to be bent, for which the bending mandrel, the turning device, etc. must be exchanged, the fulcrum 12 of pivot lever 11 must be shifted in the direction to position 12' in order for bending tool 6 to be able to again engage the free end of the wire pin to be bent. The path curve again corresponds to the dashed line 10' which, in the final phase of the bending process, coincides with the exact circular involute. Corresponding to the change in the geometric relationship, when a chain link of the shape of link 16 is to be bent, the distance of point 9 from fulcrum 12', i.e. the pivot radius of point 9, must be increased correspondingly.

Thus, if pins with greater or smaller diameter than in the illustrated example are to be bent into chain links, fulcrum 12 of pivot lever 11 must be adjusted in the direction of the Y axis (for example, to position 12'') and/or the X axis (for example, to position 12' to correspond to the changes in geometric relationships. Adjustment of the position of fulcrum 12 is effected together with a change of the respective bending mandrel. During the bending process for a given chain link size, however, the fulcrum 12 remains stationary with respect to the bending mandrel.

If instead of a pivot lever a carriage guide is employed, the starting position for both guide carriages must be newly positioned to correspond to the change in geometric relationships for bending chain links of different sizes, and the resulting new path of the curve, which in this case each time corresponds to path curve 10, must be preset in the control device.

Figure 3:
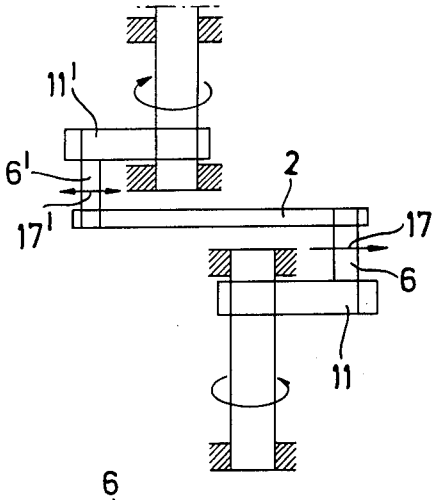
FIG. 3 is a schematic top plan view sketch of an embodiment for generating the sequence of movements.

FIG. 3 shows in a schematic top plan view how an arrangement as that described in connection with FIGS. 1 and 2, respectively, can be structurally designed with the aid of pivot levers. In this illustration the bending mandrel and all other machine parts are not shown, and only the position of wire pin 2 as well as of pivot levers 11 or 11', respectively, are shown to which the corresponding bending tools 6 or 6', respectively, are fastened.

The bending tools 6 or 6', respectively, can be articulated to the pivot lever at a distance — which is fixed for each chain link size — from the axis of rotation of the respective pivot lever, or, as indicated by arrows 17 or 17', respectively, they can be guided toward the pivot lever as carriages, in which case the control of the pivot movement on the one hand and the radial movement of the bending tool 6 performed with respect to the axis of rotation on the other hand are such that the superposition of both movements corresponds to the respective circular involute. Since, however, this path of movement can be precisely defined mathematically, it may be obtained not only by the already mentioned superposition of one movement in each the X and the Y direction, but also by a superposition of a circular movement and a movement radial thereto. This can be realized by means of a corresponding designed control device.

Figure 4:
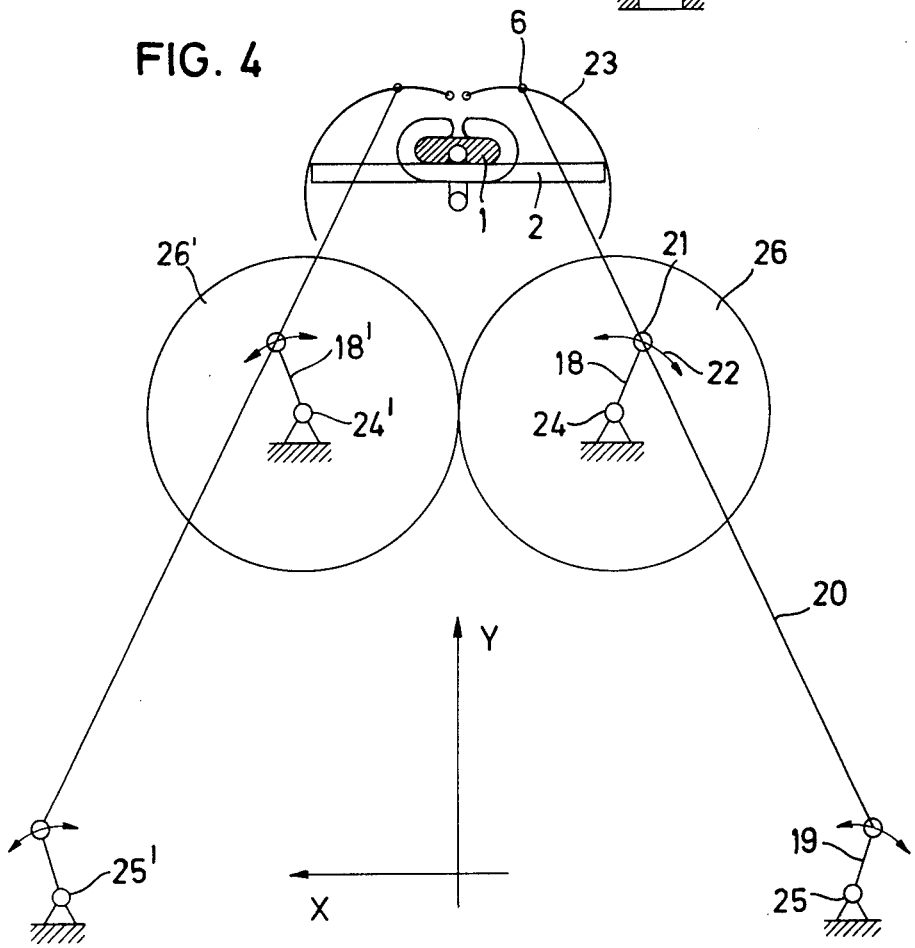
FIG. 4 is a schematic illustration of a further embodiment for generating the path of movement with the aid of pivot levers.

While the solutions proposed in FIGS. 1, 2 and 3 require a position for fulcrum 12 for the pivot levers which in a chain link bending machine is spatially limited due to the required fastenings for bending mandrel, guide for the turning tongues, etc., FIG. 4 presents a schematic view of an arrangement in which the required fulcrums for the pivot levers can be arranged outside of this structurally difficult region. This is accomplished in that two parallel pivot levers 18 and 19 are provided which are connected together by means of a coupling rod 20 to form an articulated linkage. One end of the coupling rod is extended beyond the point of articulation 21 at pivot lever 18. To the end of this extension there is fastened a bending tool 6 so that when pivot lever 18 is pivoted according to arrow 22, the circular path curve 23 results. The position of fulcrums 24 and 25, respectively, of pivot levers 18 and 19, respectively, with respect to the bending mandrel has again been selected so that the path of movement 23 corresponds to a correspondingly associated circular involute in the final phase of the bending process. The bending mandrel 1 as well as the wire pin 2 to be bent, when still in the unbent state and also in the completely bent state, are shown schematically in FIG. 4. FIG. 4 also shows that - as mentioned earlier - the bending process takes place symmetrically, i.e. both free ends of wire pin 2 are bent around the bending mandrel simultaneously. In the illustrated example the symmetry of movement can be effected, for example, by meshing toothed gears 26, 26' which are connected to pivot levers 18 or 18', respectively. One of the two toothed gears is connected with a drive.

The adjustment of the machine to various pin diameters or lengths in this device too is effected by corresponding displacement of fulcrums 24, 25 or 24', 25', respectively, in the direction of the Y axis and/or the X axis. With a chain link bending machine of this adjustable design, however, care must be taken that the two pivot levers 18 or 18', respectively, are appropriately coupled, so that they can be driven while allowing any desired, but symmetrical shift in the fulcrums 24 or 24', respectively, and 25 or 25', respectively, in the direction of the X axis and the Y axis.

Figure 5:
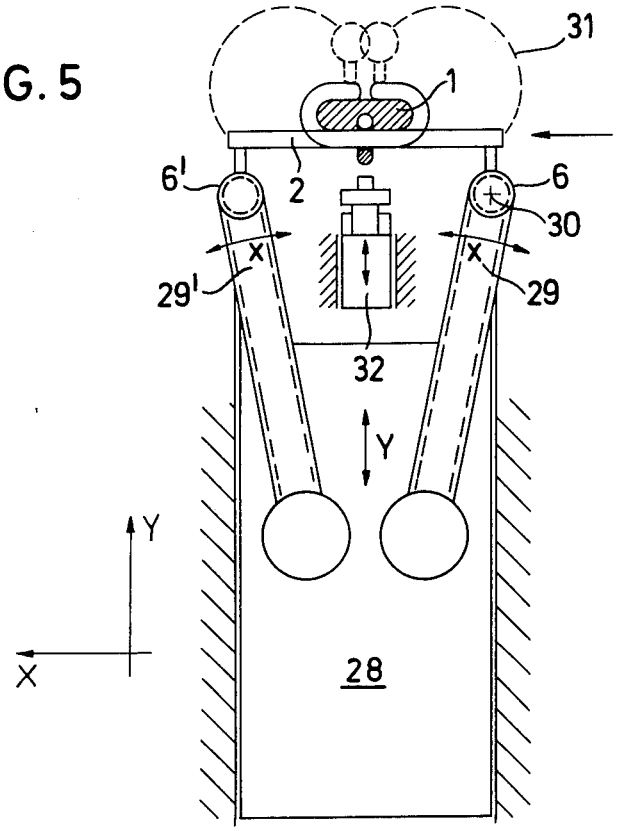
FIGS. 5 and 6 are schematic illustrations of embodiments for generating the path of movement by superposition of two mutually perpendicularly guided movements.

In deviation from the above-discussed possibility of producing the path of movement of the bending tool with the aid of two linear, superposed movements in the X and Y directions, FIG. 5 shows an arrangement in which two pivot levers 29, 29' are fastened on a carriage which can be moved back and forth in the Y direction and through which it is possible to impart a movement to the bending tools 6, 6' approximately in the X direction. In superposing the two movements, the control of the pivot movement of pivot levers 29, 29' must take into consideration that the movement of the pivot levers does not take place exactly in the X direction but constitutes a circular movement. In such an embodiment it is advisable for the pivoting movement of the bending tool 6 or 6', respectively, to take place positively as a function of the movement of carriage 28 and bending levers 29, 29' so that care is taken that the bending tool is guided accurately. FIG. 5 again shows a wire pin 2 in the unbent state and in the completely bent state, the path curve of fulcrum 30 of the bending tool being indicated by the dashed curve 31. The end position of the bending tool is also shown.

In this figure, the position of the so-called turning tongues 32 is indicated which grip the respective, completely bent chain link, pivot it by 90° and insert it into a recess in bending mandrel 1 so that a new wire pin 2 can be pushed through between bending mandrel and chain link.

Figure 6:
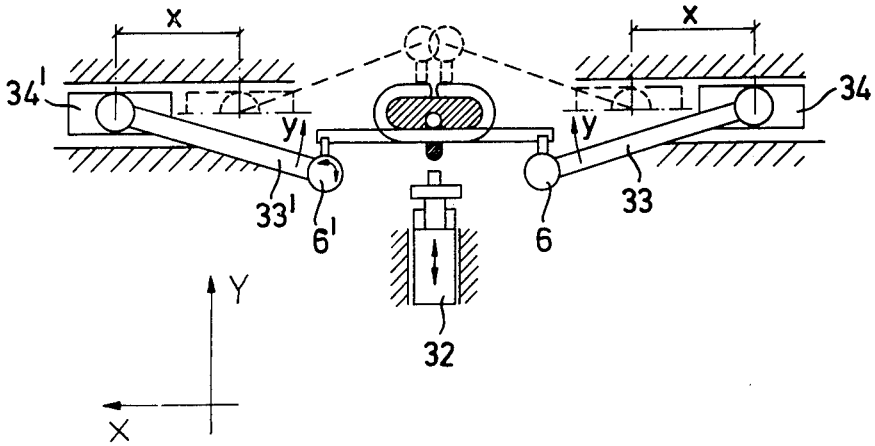

FIG. 6 shows a modified version of the chain link bending machine discussed in connection with FIG. 5. In this embodiment, each pivot lever 33, 33' is fastened to its own carriage 34, 34' which is now moved in the X direction. The pivot levers produce the movement in the Y direction under consideration of the fact that this is a circular movement. In this embodiment it is also advisable for the bending tools 6, 6' to be provided with a drive which effects positive control of the pivoting movement during the bending process.

While the chain link bending machine described in connection with FIGS. 5 and 6, in which the movement curve, with the aid of two superposed movements which extend substantially in the X direction and in the Y direction, permits guidance of the bending tool on a path which precisely follows the required circular involute, it nevertheless requires considerable technical and structural expenditures. In contradistinction thereto, the structure principle of FIG. 4 requires much less expenditures and one is not limited to the illustrated four-joint linkage. Depending on the desired degree of coincidence of the coupling curve performed by the bending tool with the precise circular involute, a plurality of possible coupling drives can be selected from an available collection of coupling curves since each time only part of the coupling curve is required for the bending process.

What is claimed is:

1. In a method of forming chain links from wire pins each having a given length and two free ends, including the steps of positioning the pin in the zone of a mandrel having opposite arcuate work faces each having a center of curvature, positioning bending tools in the zone of each free end and engaging the pin by the bending tools at a contact location in the zone of each free pin end and bending the zones of the free pin ends about the respective work faces of the mandrel by the bending tools, wherein the improvement comprises the step of guiding each said bending tool, during the bending step, in a curved path such that each said contact location describes, at least in the final phase of the bending step, at least approximately, a circular involute, the reference point of which coincides with the center of curvature of the respective work faces for substantially preventing displacement of each said contact location along the pin during the bending step.

2. A method as defined in claim 1, wherein said guiding step comprises the step of superposing a first motion of each bending tool in the Y-direction which is transverse to the axis of the unbent pin, on a second motion of each bending tool in the X-direction which is parallel to said axis, said step of superposing including the step of controlling the motion in the X-direction as a function of the motion in the Y-direction.

3. A method as defined in claim 1, wherein each bending tool is movably mounted on a pivotally supported lever, wherein said guiding step comprises the step of pivoting said lever and simultaneously effecting a relative motion between the bending tool and the associated lever for generating a movement of the contact locations along said at least approximately circular involute.

4. A method as defined in claim 3, wherein said guiding step comprises the step of superposing a first motion of each bending tool in the Y-direction which is transverse to the axis of the unbent pin, on a second motion of each bending tool in the X-direction which is parallel to said axis, said step of superposing including the step of effecting a forced pivotal motion of the bending tools relative to the respective lever as a function of the motion of the bending tools in at least one of said Y- and X-directions.

5. In a chain link bending machine for forming chain links from wire pins each having a given length and two free ends; the machine including a mandrel having opposite curved work faces each having a center of curvature; bending tools having means for engaging end zones of the wire pin to provide contact locations between each end zone and the respective work tool for bending each wire pin in a bending plane about the work faces of the mandrel during the bending operation; the improvement comprising guide means for guiding said bending tools in a path having, at least in the terminal phase of the bending operation, at least the approximate shape of a circular involute, the reference point of which coinciding with the center of curvature of the respective work faces; said guide means including a separate pivot lever associated with each bending tool and having first and second ends; each respective bending tool being pivotally mounted to the first end of the associated pivot lever to provide for a pivotal motion of the bending tool with respect to the associated pivot lever; and a separate fulcrum pivotally supporting each pivot lever at said second end thereof.

6. A chain link bending machine as defined in claim 5, wherein each fulcrum is stationarily mounted at a location corresponding to a given pin length.

7. A chain link bending machine as defined in claim 5, wherein each said fulcrum is adjustable in two coordinate directions lying in a plane that is parallel to said bending plane.

8. A chain link bending machine as defined in claim 5, wherein the pivotal axis of each bending tool is adjustable in its distance from the fulcrum of the respective pivot lever.

9. A chain link bending machine as defined in claim 5, wherein each fulcrum is supported stationarily during the bending operation.

* * * * *